US010036615B2

(12) United States Patent
Norris et al.

(10) Patent No.: US 10,036,615 B2
(45) Date of Patent: Jul. 31, 2018

(54) ENTANGLING PROJECTILE DEPLOYMENT SYSTEM

(71) Applicant: Wrap Technologies, Inc., Las Vegas, NV (US)

(72) Inventors: Elwood Norris, Las Vegas, NV (US); James Barnes, Las Vegas, NV (US)

(73) Assignee: Wrap Technologies, Inc., Las Vegas, NV (US)

( * ) Notice: Subject to any disclaimer, the term of this patent is extended or adjusted under 35 U.S.C. 154(b) by 0 days.

(21) Appl. No.: 15/081,440

(22) Filed: Mar. 25, 2016

(65) Prior Publication Data

US 2017/0276459 A1 Sep. 28, 2017

(51) Int. Cl.
*F41H 13/00* (2006.01)
*F42B 12/66* (2006.01)

(52) U.S. Cl.
CPC ..... *F41H 13/0006* (2013.01); *F42B 12/66* (2013.01)

(58) Field of Classification Search
CPC ..... F41H 13/0006; F42B 12/66; F42B 30/00; F41B 11/62
See application file for complete search history.

(56) References Cited

U.S. PATENT DOCUMENTS 34,626 A * 3/1862 Ely ..... F42B 12/66 102/504
34,628 A * 3/1862 Gault ..... F42B 12/66 102/504
35,734 A * 6/1862 Gault ..... F42B 12/66 102/504
39,282 A * 7/1863 Ganster ..... F42B 12/66 102/504
347,988 A 8/1886 Boyd
1,151,070 A * 8/1915 Victory ..... F42B 12/66 102/504
1,198,035 A 9/1916 Huntington
1,211,001 A 1/1917 Steinmetz
1,217,415 A * 2/1917 Victory ..... F42B 12/68 102/504
1,229,421 A * 6/1917 Downs ..... F42B 12/66 102/504
1,276,689 A * 8/1918 Poudrier ..... F41F 1/06 89/1.1

(Continued)

FOREIGN PATENT DOCUMENTS

CA 2162221 A1 5/1996
DE 3522661 A1 1/1987
JP 2011/106748 A 6/2011

*Primary Examiner* — Troy Chambers
*Assistant Examiner* — Bridget A Cochran
(74) *Attorney, Agent, or Firm* — Thorpe North & Western, LLP

(57) ABSTRACT

A projectile deployment system includes an entangling projectile having a pair of pellets and a tether connecting the pellets. A projectile casing includes a pair of sockets, each socket sized to carry one of the pellets, the sockets being oriented at an acute angle relative to a longitudinal axis of the projectile casing such that the pellets travel apart from one another as they are expelled from the projectile casing. A launcher carries the casing and includes a selectively activatable pressure source capable of expelling the entangling projectile from the projectile casing toward a subject.

20 Claims, 7 Drawing Sheets

(56) References Cited

U.S. PATENT DOCUMENTS 1,304,857 A * 5/1919 Davis ..... F41A 21/28 102/504
1,343,747 A 6/1920 Radakovich
1,488,182 A 3/1924 Whelton
1,536,164 A 5/1925 Tainton
2,354,451 A 7/1944 Forbes
2,372,383 A * 3/1945 Lee ..... F41H 11/04 102/504
2,373,363 A * 4/1945 Wellcome ..... F41H 13/0006 102/504
2,373,364 A 4/1945 Wellcome
2,455,784 A 12/1948 Lapsensohn
2,611,340 A * 9/1952 Manning ..... A01K 15/003 119/802
2,668,499 A * 2/1954 Mourlaque ..... F41H 13/0006 102/504
2,797,924 A * 7/1957 Stewart ..... A63B 65/00 119/801
3,085,510 A 4/1963 Campbell
3,340,642 A 9/1967 Vasiljevic
3,484,665 A 12/1969 Mountjoy et al.
3,583,087 A 6/1971 Huebner
3,717,348 A * 2/1973 Bowers ..... A63F 9/0243 273/343
3,773,026 A 11/1973 Romero
3,803,463 A * 4/1974 Cover ..... F41B 15/00 361/232
3,831,306 A * 8/1974 Gregg ..... F41A 21/40 42/79
3,921,614 A 11/1975 Fogelgren
4,027,418 A 6/1977 Baldie et al.
4,166,619 A 9/1979 Bergmann et al.
4,193,386 A 3/1980 Rossi
4,253,132 A * 2/1981 Cover ..... F41H 13/0006 361/232
4,318,389 A 3/1982 Kiss, Jr.
4,466,417 A 8/1984 Mulot et al.
4,559,737 A * 12/1985 Washington ..... F41A 21/32 102/504
4,656,947 A * 4/1987 Gordon ..... F42B 12/745 102/438
4,664,034 A * 5/1987 Christian ..... F42B 12/66 102/439
4,750,692 A * 6/1988 Howard ..... B64G 1/648 102/504
4,752,539 A 6/1988 Vatter
4,912,867 A * 4/1990 Dukes, Jr. ..... F41A 17/54 224/238
4,912,869 A * 4/1990 Govett ..... F41C 7/00 42/105
4,962,747 A 10/1990 Biller
5,003,886 A 4/1991 Pahnke et al.
5,078,117 A 1/1992 Cover
5,103,366 A 4/1992 Battochi
5,145,187 A 9/1992 Lewis
5,279,482 A * 1/1994 Dzenitis ..... B64G 1/648 102/504
5,314,196 A 5/1994 Ruelle
5,315,932 A * 5/1994 Bertram ..... F41H 13/0006 102/438
5,326,101 A * 7/1994 Fay ..... F41B 11/57 124/1
5,372,118 A 12/1994 Schmidt, III et al.
5,396,830 A * 3/1995 Kornblith ..... F41F 1/00 102/504
5,460,155 A * 10/1995 Hobbs, II ..... F41H 13/0006 124/1
5,561,263 A * 10/1996 Baillod ..... F41H 13/0006 102/483
5,649,466 A * 7/1997 Genovese ..... B64D 45/0015 102/293
5,654,867 A 8/1997 Murray
5,698,815 A * 12/1997 Ragner ..... F41H 13/0006 102/293
5,706,795 A * 1/1998 Gerwig ..... F41B 11/62 124/71
5,750,918 A * 5/1998 Mangolds ..... F41H 13/0006 102/213
5,786,546 A 7/1998 Simson
5,814,753 A * 9/1998 Rieger ..... F42B 12/66 102/293
5,831,199 A * 11/1998 McNulty, Jr. ..... F41H 13/0025 89/1.11
5,898,125 A * 4/1999 Mangolds ..... F41H 13/0006 102/293
5,904,132 A 5/1999 Biller
5,943,806 A 8/1999 Underwood
5,962,806 A 10/1999 Coakley et al.
5,996,504 A 12/1999 Lowery
6,283,037 B1 * 9/2001 Sclafani ..... F42B 12/34 102/444
6,381,894 B1 * 5/2002 Murphy ..... F41A 21/32 42/77
6,382,071 B1 * 5/2002 Bertani ..... F41C 27/00 124/59
6,543,173 B1 * 4/2003 Golan ..... F41A 19/09 42/75.04
6,575,073 B2 6/2003 McNulty, Jr. et al.
6,615,622 B2 * 9/2003 MacAleese ..... E05B 75/00 463/47.4
6,636,412 B2 10/2003 Smith
6,729,222 B2 5/2004 McNulty, Jr.
6,820,560 B1 11/2004 Romppanen
6,880,466 B2 4/2005 Carman
6,898,887 B1 5/2005 Stratbucker
7,042,696 B2 * 5/2006 Smith ..... F41H 13/0031 361/232
7,065,915 B2 6/2006 Chang
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 * 1/2008 Su ..... F41B 11/62 102/502
7,327,549 B2 * 2/2008 Smith ..... F41H 13/0025 102/502
7,412,975 B2 * 8/2008 Dillon, Jr. ..... F41B 11/62 102/440
7,444,939 B2 11/2008 McNulty et al.
7,444,940 B2 11/2008 Kapeles et al.
7,640,839 B2 1/2010 McNulty, Jr.
7,640,860 B1 * 1/2010 Glover ..... F42B 12/34 102/456
7,673,411 B1 3/2010 Baldwin
7,686,002 B2 * 3/2010 Andrews ..... F41B 11/89 124/1
7,778,005 B2 8/2010 Saliga
7,791,858 B2 * 9/2010 Hummel ..... F42D 1/055 102/262
7,856,929 B2 * 12/2010 Gavin ..... F41H 13/0031 102/400
7,859,818 B2 12/2010 Kroll et al.
7,900,388 B2 3/2011 Brundula et al.
7,905,180 B2 3/2011 Chen
7,950,176 B1 5/2011 Nemtyshkin
7,950,329 B1 5/2011 Nemtyshkin et al.
7,984,676 B1 * 7/2011 Gavin ..... F42B 5/073 102/502
8,024,889 B2 9/2011 Bunker
8,082,199 B2 12/2011 Kwok
8,141,493 B1 * 3/2012 Kuchman ..... F41H 13/0006 102/439
8,186,276 B1 * 5/2012 Olden ..... F42D 5/05 102/502
8,231,474 B2 7/2012 Stethem
8,245,617 B2 * 8/2012 Martinez ..... B63G 9/04 114/382
8,261,666 B2 9/2012 Garg

(56) References Cited

U.S. PATENT DOCUMENTS 8,281,776 B2 * 10/2012 Korver ..... F41B 11/723 124/73
8,339,763 B2 12/2012 McNulty, Jr.
8,441,771 B2 5/2013 Hinz et al.
8,561,516 B2 * 10/2013 Martinez ..... E01F 13/12 404/6
8,601,928 B2 * 12/2013 Martinez ..... B63G 9/04 114/317
8,671,841 B2 * 3/2014 Raquin ..... F42B 12/745 102/335
8,695,578 B2 * 4/2014 Olden ..... F41A 21/28 102/530
8,677,675 B2 5/2014 Koch
8,857,305 B1 10/2014 Tseng
8,896,982 B2 11/2014 Beecher et al.
8,899,139 B2 * 12/2014 Brill ..... F42B 5/02 102/436
9,025,304 B2 5/2015 Brundula et al.
9,134,099 B2 * 9/2015 Tseng ..... F41B 11/00
9,157,694 B1 10/2015 Tseng
9,220,246 B1 12/2015 Roman
9,255,765 B2 2/2016 Nelson
9,303,942 B2 * 4/2016 Sievers ..... A63H 33/18
9,414,578 B2 8/2016 Thornbrough
9,581,417 B2 2/2017 Tseng
9,638,498 B2 5/2017 Chang
2002/0134365 A1 * 9/2002 Gray ..... F41H 13/0006 124/56
2003/0165041 A1 9/2003 Stethem
2003/0165042 A1 9/2003 Stethem
2005/0166441 A1 * 8/2005 Mattox ..... A01M 23/00 43/1
2007/0101893 A1 * 5/2007 Shalev ..... F41H 13/0006 102/512
2007/0264079 A1 * 11/2007 Martinez ..... E01F 13/12 404/6
2009/0084284 A1 * 4/2009 Martinez ..... B63G 9/04 102/504
2010/0126483 A1 * 5/2010 Makowski ..... F41B 3/04 124/5
2010/0315756 A1 12/2010 Gavin
2011/0005373 A1 1/2011 Martinez et al.
2011/0271825 A1 * 11/2011 Howland ..... F41B 15/10 89/36.02
2012/0019975 A1 1/2012 Hanchett et al.
2012/0210904 A1 * 8/2012 Merems ..... F41H 11/02 102/504
2014/0331984 A1 * 11/2014 Brahler, II ..... F41B 11/723 124/76
2015/0075073 A1 * 3/2015 Sylvester ..... E05G 1/10 49/24
2015/0168107 A1 6/2015 Tseng
2015/0241180 A1 * 8/2015 Pruett ..... F41H 11/02 89/1.11
2015/0316345 A1 * 11/2015 Brahler, II ..... F41B 11/72 124/73
2016/0161225 A1 6/2016 Searle et al.
2016/0238350 A1 * 8/2016 Tseng ..... F41H 13/0006
2017/0160060 A1 6/2017 Purvis
2017/0241751 A1 8/2017 Nerheim

* cited by examiner

ENTANGLING PROJECTILE DEPLOYMENT SYSTEM

BACKGROUND OF THE INVENTION

Field of the Invention

The present invention relates generally to non-lethal, ranged weapons systems to aid in impeding or subduing hostile or fleeing persons of interest.

Related Art

It has been recognized for some time that police and military personnel can benefit from the use of weapons other than firearms to deal with some hostile situations. While firearms are necessary tools in law enforcement, they provide a level of force that is sometimes unwarranted. In many cases, law enforcement personnel may wish to deal with a situation without resorting to use of a firearm. It is generally accepted, however, that engaging in hand-to-hand combat is not a desirable choice.

For at least these reasons, ranged engagement devices such as the Taser have been developed to provide an alternative. While such electrical muscular disruption ("EMD") weapons have been used with some success, debates continue as to whether such devices are as safe as claimed. Other ranged engagement solutions, such as mace or pepper spray, are very limited in range and are often criticized for the pain caused to subjects and the potential for such solutions to affect police or bystanders.

As such, designers continue to seek non-lethal solutions that can be effectively used by police or law enforcement especially to impede or subdue fleeing subjects.

SUMMARY OF THE INVENTION

In accordance with one aspect of the invention, a projectile deployment system is provided, including an entangling projectile that can include a pair of pellets and a tether connecting the pellets. A projectile casing can have a pair of sockets, each socket sized to carry one of the pellets, the sockets being oriented at an acute angle relative to a longitudinal axis of the projectile casing such that the pellets travel apart from one another as they are expelled from the projectile casing. A launcher can carry the casing and can include a selectively activatable pressure source capable of expelling the entangling projectile from the projectile casing toward a subject.

In accordance with another aspect of the invention, a projectile deployment system is provided, including a firearm carrying one or more shell casings capable of being discharged to generate a pressure wave. An entangling projectile can include a pair of pellets and a tether connecting the pellets. A projectile casing can be carried by the firearm, the projectile casing including a pair of sockets, each socket carrying one of the pellets. The projectile casing can be in fluid communication with the firearm such that discharging one of the shell casings with the firearm results in expelling the entangling projectile from the projectile casing.

In accordance with another aspect of the invention, a projectile casing for use in a projectile deployment system is provided, the projectile casing including a containment shell having a pressure inlet and a pressure outlet. An entangling projectile can include a pair of pellets and a tether connecting the pellets. At least two sockets, sized and shaped to receive therein one of the pair of pellets, can be in fluid communication with the pressure inlet and pressure outlet of the containment shell such that application of pressure to the pressure inlet of the containment shell causes the pellets to be expelled through the pressure outlet of the containment shell. A connector can be in fluid communication with the pressure inlet, the connector operable to secure the projectile casing to a projectile launcher.

In accordance with another aspect of the invention, a method for entangling a subject is provided, including: targeting a subject with a projectile launcher, the projectile launcher carrying an entangling projectile having a pair of pellets connected by a tether, each of the pellets carried by one of a pair of sockets formed in the launcher; and activating the projectile launcher to cause the pellets to be expelled from the projectile launcher, the pellets traveling outwardly from the projectile launcher and laterally away from one another as they are being expelled from the projectile launcher Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
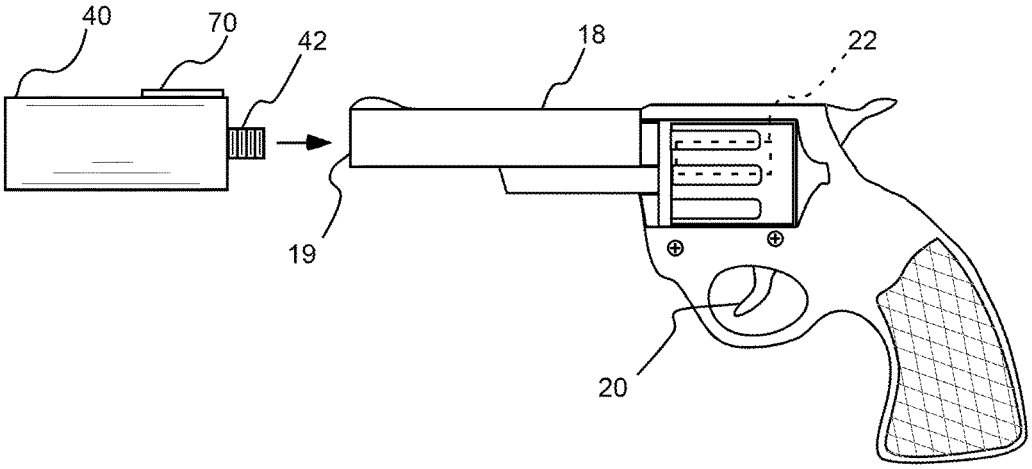
FIG. 1 is a side view of an entangling projectile deployment system in accordance with an embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a pellet" can include one or more of such pellets, if the context dictates.

As used herein, the term "firearm" can include handguns, rifles, shotguns, and other known firearms that are routinely used to fire known projectiles, such as bullets and shot. The term "firearm" includes not only well-known guns such as these that are capable of firing a bullet or pellet, but also modified versions of these that do not ordinarily fire projectiles, instead using a charge to simulate firing of a projectile. Thus, devices such as starter pistols, blank guns, prop guns, flare guns, etc., can also fall within the definition of a firearm, so long as such devices are capable of delivering a pressure wave sufficient to launch the present entangling projectiles.

Generally, devices such as starter pistols, blank guns, prop guns, etc., have been modified so that a projectile cannot be delivered down the barrel of such guns. In some cases, they are modified so that a standard cartridge, having a bullet and a casing, cannot be loaded into the firearms. However, these firearms often generally release, through the barrel, a high velocity pressure wave from a firearm blank to simulate normal firearm operation. This high velocity pressure wave can be utilized by the present technology, even if the barrel is partially blocked to eliminate the loading or passage of a conventional projectile.

As used herein, the terms "firearm blank" or "blank cartridge" refer to the well-known blank cartridge that can be used with firearms. Such blank cartridges contain gunpowder but not a bullet or shot, as such they can be discharged in conventional firearms to produce a high velocity pressure wave. Several types of firearms utilizing blank cartridges can be incorporated into the present technology.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to non-lethal weapons systems that can be effectively used as an aid in impeding the progress of or detaining aggressive or fleeing subjects. Weapons in accordance with the present technology can be advantageously used to temporarily impede a subject's ability to walk, run or use his or her arms in cases where law enforcement or military personnel wish to detain a subject, but do not wish to use lethal or harmful force. The technology provides a manner by which the arms or legs of a subject can be temporarily tethered or bound, to the extent that the subject finds it difficult to continue moving in a normal fashion.

While the present technology can be directed at any portion of a subject's body, the following discussion will focus primarily on use of the technology to temporarily tether or bind a subject's legs. It is to be understood, however, that the present technology is not limited to this application. In some cases, as discussed below, multiple portions of the subject's body can be targeted, such as both the arms and the legs.

Figure 2:
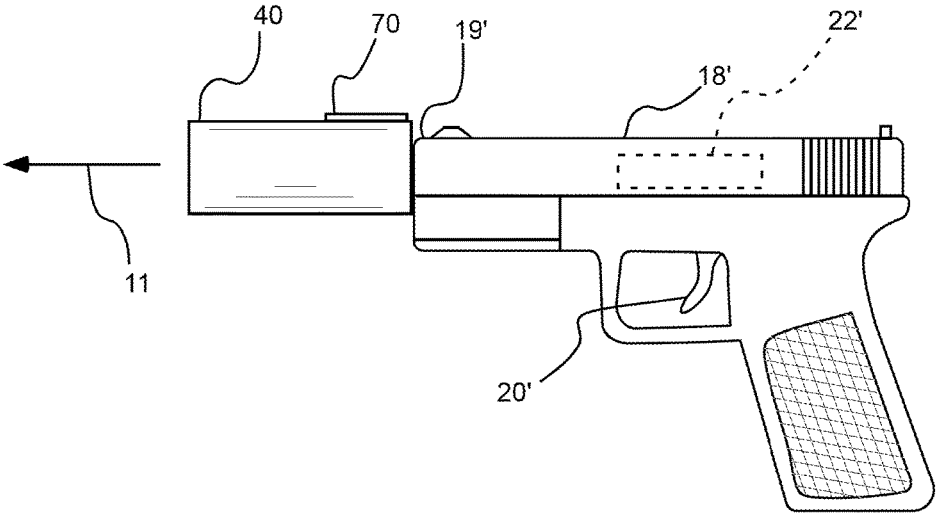
FIG. 2 is side view of another entangling projectile deployment system in accordance with an embodiment of the invention.

The present technology provides an entangling projectile 12 (See FIGS. 5, 8, etc.) that can be deployed toward to a subject's legs to cause the projectile to wrap about the subject's legs. The projectile includes at least one tether 16 and at least two pellets 14, coupled together by the tether. By engaging a subject with the entangling projectile, the subject is temporarily rendered partially or fully incapacitated and thereby restricted in his or her ability to flee or attack. The general direction of deployment is shown in FIG. 2 by reference arrows 11, relative to a launcher 18', discussed in more detail below. Typically, the projectile can be deployed toward a subject from a distance of between about 6 feet and about 30 feet (1.8 to 9.1 meters).

After being deployed from the launcher, the entangling projectile will wrap about the subject's legs two or three or more times, causing the subject to be temporarily unable to effectively move. As the projectile can be launched from some distance, law enforcement personnel can maintain a safe distance from a subject, yet still be able to effectively and safely temporarily disable or impede the subject.

Figure 8:
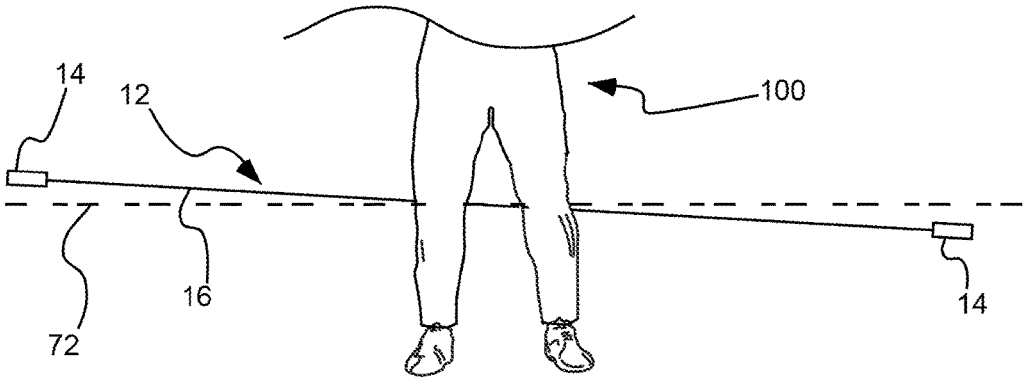
FIG. 8 is a front view of a portion of a subject in accordance with an embodiment of the invention, shown immediately prior to an entangling projectile engaging the subject's legs.

Operation of the projectile is shown generally in FIG. 8: after being released by a launcher, the projectile 12 travels toward a subject 100. As the projectile travels toward the subject, pellets 14 travel away from one another, resulting in the tether 16 being pulled substantially taught between the two. Once the projectile engages the subject (in the example shown the subject's legs are engaged), the pellets and tether wrap about the subject and thereby temporarily entangle and/or disable the subject.

A variety of differing pellet and tether combinations can be utilized in the present technology. In the examples shown in the figures, the projectile 12 includes two pellets 14 connected by a single tether 16. While more than two pellets can be utilized, the examples shown herein include only two. It has been found that limiting the number of pellets to two results in a more effective deployment system: the risk of tangling of the tether 16 is diminished and the pellets spread apart from one another much more cleanly and quickly after being deployed from the launcher. This arrangement can also allow the projectile to be more accurately directed toward a subject.

As shown in FIGS. 1 and 2, deployment of the entangling projectile generally involves two primary components: a launcher 18, 18' and a projectile casing 40. A connector 42 couples the casing 40 to the launcher 18, 18'. As described in more detail below, the projectile casing carries the entangling projectile in a configuration ready to deploy. Application of a high velocity pressure wave through the projectile casing causes the projectile to be rapidly expelled from the casing toward the subject. Thus, the launcher can take a variety of forms, so long as it is capable of delivering to the projectile casing a high velocity pressure wave that results in the entangling projectile being rapidly propelled from the casing. More detail directed to selection and operation of the launcher is provided in the pages below.

Figure 3A:
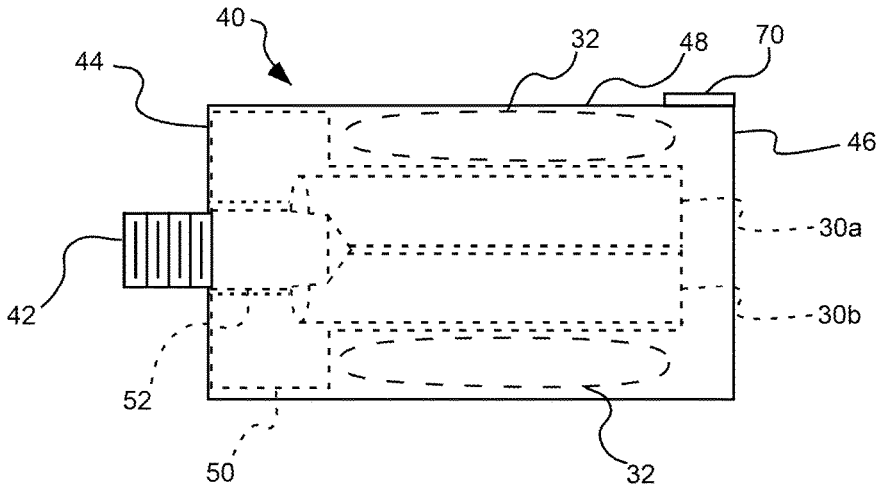
FIG. 3A is a side view of a projectile casing in accordance with an embodiment of the invention.
Figure 3B:
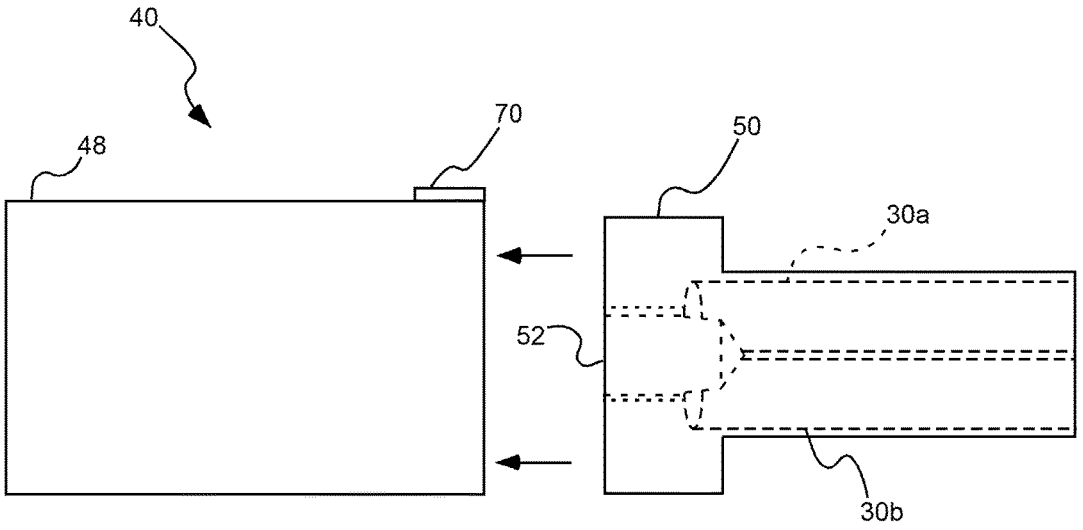
FIG. 3B is a side view of the projectile casing of FIG. 3A, shown in an exploded configuration.

FIGS. 3A through 4E illustrate various features of the projectile casing. As shown in FIGS. 3A and 3B, the casing 40 can include an outer containment shell 48 and an inner core or block 50. In this embodiment, the containment shell and inner block cooperatively form a tether storage compartment 32 (FIG. 3A). The tether 16 is illustrated in FIG. 4D in the position it would take when stored in this compartment. This configuration allows easy loading and storage of the tether prior to deployment of the entangling projectile from the projectile casing 40. The tether can be positioned in the tether storage compartment while the outer shell and inner block are assembled (FIG. 3A), or while the inner block is removed from the outer shell (FIG. 3B).

The inner block 50 can include one or more sockets 30*a*, 30*b*, etc. The sockets can each hold one pellet (14*a*, 14*b*, FIG. 4D) prior to deployment of the pellets from the projectile casing. A channel 52 can be formed through an input end 44 of the inner block, and can be in fluid communication with each of the sockets 30*a*, 30*b*. Connector 42 can provide fluid communication from the launcher 18, 18', etc., through the channel 52, to each of the sockets 30*a*, 30*b*. Thus, as a high pressure wave is generated by the launcher, it is directed through the connector 42 and channel 52, and is applied to the pellets held in sockets 30*a*, 30*b*. The pellets are then forcibly expelled from the inner block toward the subject.

Figure 4A:
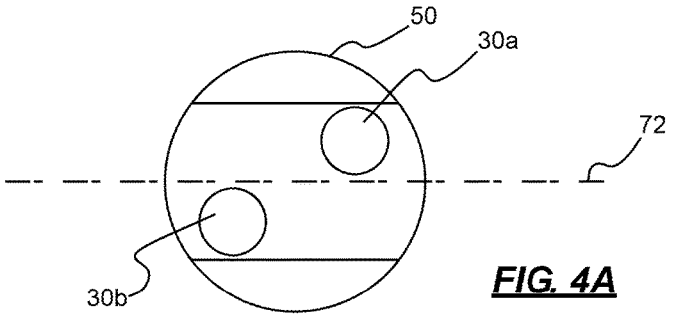
FIG. 4A is a front view of an inner block of the casing of FIG. 3A.
Figure 4B:
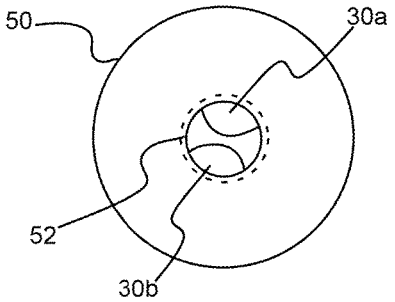
FIG. 4B is a rear end view of the inner block of FIG. 4A.
Figure 4C:
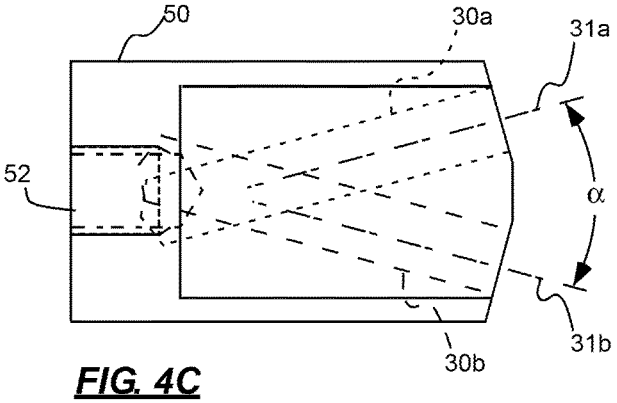
FIG. 4C is a top view of the inner block of FIG. 4A.
Figure 4D:
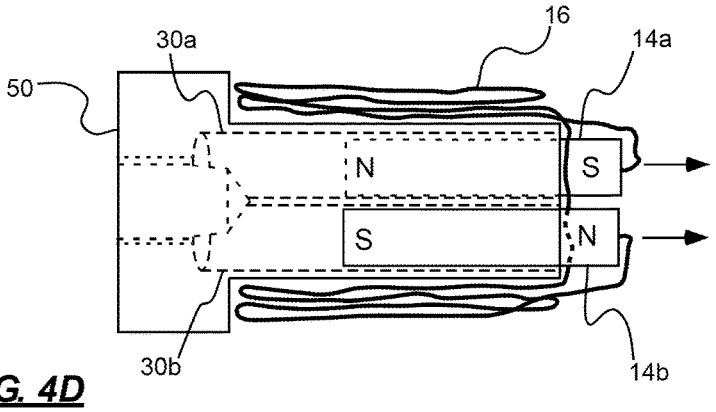
FIG. 4D is a side view of the inner block of FIG. 4A, shown with two pellets partially expelled therefrom.
Figure 4E:
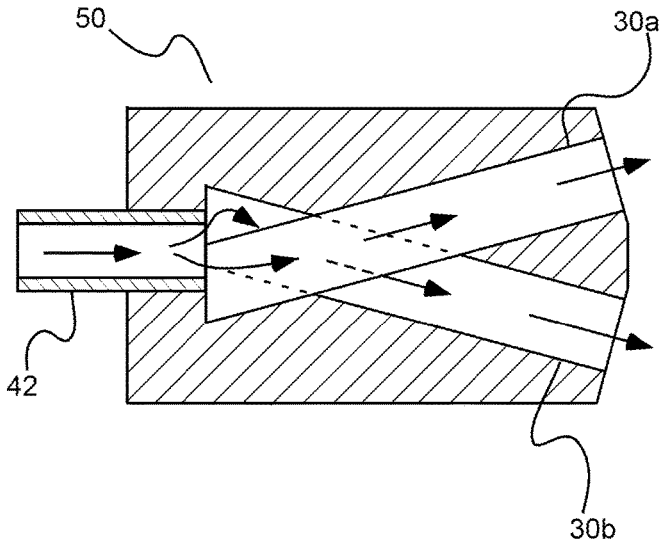
FIG. 4E is a top, sectioned view of the inner block of FIG. 4A.

As best appreciated from FIG. 4C, the sockets 30*a*, 30*b* can be oriented at an angle "α" relative to one another. While the angle can vary, it is generally an acute angle, typically ranging from about 10 degrees to about 60 degrees. In another embodiment, the angle can range between about 25 degrees to about 45 degrees. In another embodiment, the angle is about 30 degrees. By angling the sockets relative to one another, the pellets are directed away from one another as they are expelled from the sockets. In this manner, the pellets separate relative to one another very quickly, pulling the tether 16 taut between them so that the tether can fully extend prior to engaging the subject.

Figure 7A:
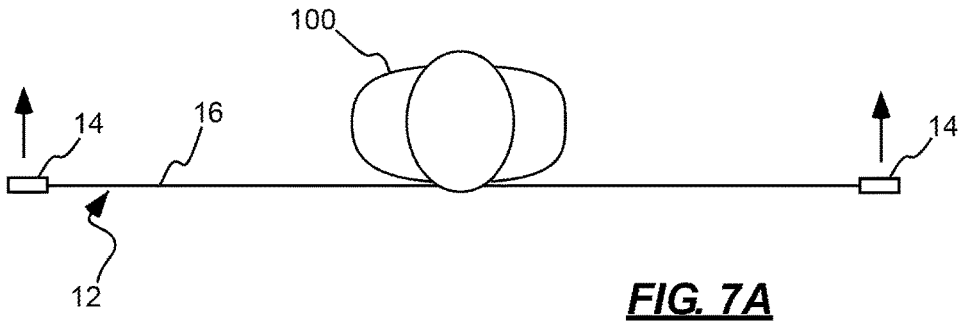
FIG. 7A is a top view of a subject toward which an entangling projectile was launched, shown immediately prior to the entangling projectile engaging the subject.
Figure 7B:
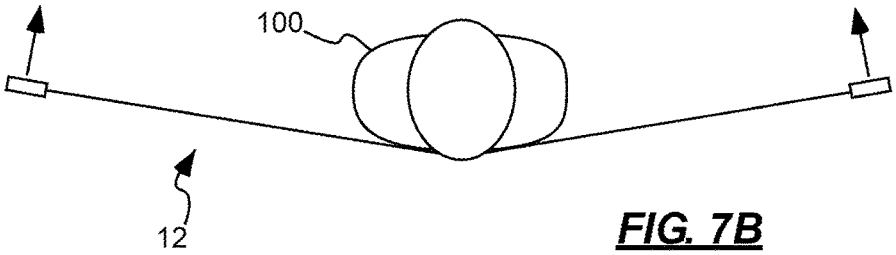
FIG. 7B is a top view of the subject and projectile of FIG. 7A, shown shortly after the entangling projectile engaged the subject.

The result of this configuration is shown in FIGS. 7A and 7B. In 7A, the entangling projectile 12 has been launched toward a subject 100 (shown from above) and has traveled to engage the subject. Prior to contacting the subject, the tether 16 has been pulled taut, such that the pellets 14 are travelling in a linear direction toward the subject. Immediately after the tether 16 contacts the subject, the momentum of the pellets, prevented by the tether from continuing along their present trajectory, causes them to begin moving toward one another (shown in FIG. 7B), which momentum will cause the pellets to orbit about the subject.

As the pellets orbit about the subject's legs, the tether wraps itself tightly about the subject's legs. Note that, as the tether wraps about the subject's legs, the rotational velocity of the pellets will increase, causing them to wrap more quickly as the effective length of the tether is decreased. In an average deployment, the pellets will wrap themselves about the subject's legs 2-3 times, resulting in the tether being wrapped about the subject's legs 4-6 times. As will be appreciated, a subject will at least temporarily have great difficulty moving after the tether is thus wrapped about his or her legs.

As will also be appreciated from FIG. 4C, the axes 31*a*, 31*b* of the sockets 30*a*, 30*b* can intersect one another at a location within the inner block 50. That is, a portion or section of one of the sockets can intersect with a portion or section of the other socket. In the example shown, sockets 30*a* and 30*b* intersect or overlap where each socket is fluidly coupled to pressure inlet 52. The sockets can also be stacked horizontally relative to one another, to provide an overlapping configuration of one atop the other. In this manner, the sockets can be spaced relatively close to one another while also maintaining a desired angle between the two. The location at which the sockets intersect can be adjusted nearer to or further from the input end 44 of the block. Connector 42 can extend into the block to the extent necessary to provide a fluid path from the firearm or launcher to each of the sockets. As is shown by the directional arrows in FIG.

4E, fluid flow can enter connector 42 and travel toward the sockets 30*a*, 30*b*. This fluid flow is divided when encountering the sockets, with some fluid flow traveling upwardly into and through socket 30*a*, and some traveling downwardly into and through 30*b*. In one embodiment, equal fluid flow can be provided to each socket to thereby apply an equal propelling force to each pellet.

This feature allows the use of a relatively narrow projectile casing regardless of the angle at which it is desired to orient the sockets. If the sockets were merely oriented in a side-by-side relationship, without overlapping axes, the width or diameter of the projectile casing would have to be increased as the angle "α" between the socket axes 31 was increased. By overlapping the axes, however, this limitation in arranging the sockets is eliminated. This can allow the projectile casing to be much more narrow than otherwise possible. This results in a launcher system that can be easily carried by law enforcement personnel, similar to conventional firearms. While not so limited, in one aspect of the invention, the projectile casing 40 can be formed having a diameter or maximum width of less than about two inches (5.1 cm), and as little as 1½ inches (3.8 cm) or less. The projectile casing can be formed with a length of less than about 2½ inches (6.4 cm), or as little as two inches (5.1 cm) or less.

Figure 5:
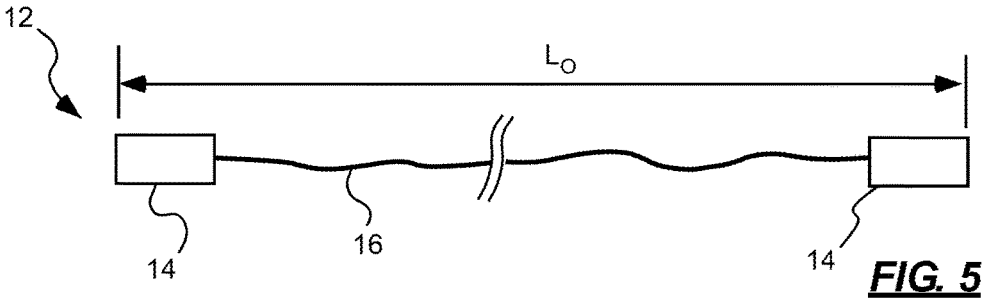
FIG. 5 is a top, bottom, front or rear view of an entangling projectile extended substantially to its full length in accordance with an embodiment of the invention.

FIG. 5 illustrates the projectile 12 extended to its full length "L." In one embodiment, the overall length of the tether is much longer than the size of pellets. The overall length can be on the order of eight feet (2.4 meters) or greater. The pellets can have a length on the order of an inch (2.54 cm), and a diameter on the order of ⅜ of an inch (0.95 cm). While differing embodiments of the technology can vary, it is generally desirable to maintain the pellets at a relatively small size to thereby limit the overall size requirements of the projectile casing that houses the pellets prior to deployment.

The pellets 14 can be formed from a variety of materials. In one embodiment, they can be formed from ordinary steel rod or lead. In other embodiments, however, it may be desirable to provide a pellet with a softer material or material surface that contacts the subject. As the present technology is intended to temporarily subdue subjects while minimizing injury to them, a softer material or outer material surface may reduce the risk that the subject will be injured during deployment of the entangling projectile. Such materials can include, without limitation, wax, rubber, polymeric materials, fabric coatings, etc.

Figure 6A:
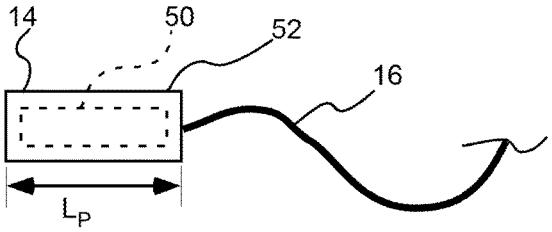
FIG. 6A is a side view of a pellet and a portion of a tether of the projectile of FIG. 5.
Figure 6B:
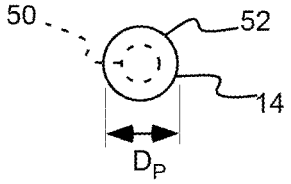
FIG. 6B is an end view of the pellet of FIG. 6A.

In the embodiment shown in FIGS. 6A and 6B, the pellet 14 can include an inner core material 50 and outer shell material 52. In this manner, the inner core material can be selected to achieve a desirable pellet characteristic: for example, density can be considered in order to modify a weight of the pellet, or a magnetized material can be used to magnetize the pellet. The outer shell 52 can be selected to achieve another objective: for example, a softer material can be selected to minimize trauma to the subject, or a material that aids in properly expelling the pellets from the launcher can be considered to improve ballistics. Thus, for example, the inner core 50 can be formed from a relatively hard magnetic material such as Neodymium Iron Boron (NIB), while the outer shell can be formed from wax or rubber.

Forming one or both of the pellets 14 partially or fully from a magnetized material can cause the pellets to be magnetically attracted to one another. This can be advantageous in that, after the pellets have wound about the subject (that is, once the tether has wrapped about the subject's legs), they can magnetically engage one another. This can result in the entangling projectile being more securely attached about the subject, and can also limit the amount the tether can "unwind" after winding about the subject.

Forming the pellets from a magnetized material can also aid in retaining the pellets within the sockets prior to deployment. As shown for example in FIG. 4D, each of the pellets 14*a*, 14*b* can include magnetic poles. The pellets can be loaded into the sockets such that the north pole of pellet 14*a* is oriented toward the rear of the system, while north pole of pellet 14*b* is oriented toward the forward end of the system. In this manner, the magnets will be attracted to another while being stored in the sockets. As the sockets are angled relative to one another (see FIG. 4C), the tendency of the pellets to move toward one another will force them backward within the sockets, and tend to maintain them in this position prior to deployment.

While the pellets 14 are illustrated as cylindrical in shape, it is understood that they may be formed in a spherical configuration, or they may be rectangular blocks or other oblong shapes. They may be of varied dimension and weight, surface finish, etc.

In one embodiment, the tether or pellets (or both) can be coated in a visible or invisible marking substance, such as a coloring dye. In this manner, the subject, even if able to extricate himself from the entangling projectile, is identifiable as being a subject that came into contact with the projectile. This can aid in later identification should the device not fully or sufficiently detain a subject for a sufficient period of time.

The pellets 14, outer shell 52, tether 16, etc., can also include structure that can aid in limiting a subject's ability to quickly disengage from the tether. Fore example, small knots can be formed in the tether at regular intervals. These knots can engage clothing worn by the subject to limit the subject's ability to quickly disengage from the projectile. In another example, barbs or hooks can be carried by the outer shell or along a portion of the tether near the pellets, or the outer shell can be formed from a material containing such structure. Such barbs or hooks can formed in a configuration or from a material that renders them unlikely to injure a subject, but still provide a manner in which the projectile can be temporarily secured about a subject. Spheres or other irregularities can be coupled to or formed around the tether for the same purpose.

After the pellets and tether have wrapped about a subject, the barbs or hooks can engage each other from alternative ends of the outer shell or tether or engage clothing worn by the subject, and thereby more securely retain the tether wrapped about the subject. Further, similar to the effect created by utilizing magnetized pellets, the outer shell 62 or the tether can include engagement structure that causes the pellets or the ends of the tether to engage one another after wrapping about the subject. For example, hook-and-loop material can be carried by the outer shell such that the pellets engage one another after wrapping about the subject.

The tether 16 can also be formed from a variety of materials. In one aspect, the tether is formed from conventional nylon material. Waxed cord can also be used, as the wax can aid in packing and/or coiling the tether to properly fit within, and stay within, the tether compartments. In one embodiment, the tether can be formed from an elastic material. The elastic material can allow the tether to extend from a nominal configuration (e.g., "L" in FIG. 5), to a longer, extended configuration. In one example, the tether can extend as much as 20% to 300% of its original length. By providing elasticity to the tether, the tether can be extended by the momentum of the pellets as the entangling projectile is propelled toward a subject. Thus, at the moment shown in FIG. 7A immediately prior to contact with the subject 100, the tether 16 can be in an extended configuration. Once the tether contacts the subject, the elastic properties of the tether can aid in pulling the pellets around the subject. In this manner, in addition to the momentum of the pellets causing them to wrap about the subject once the tether contacts the subject, the elasticity in the tether can also aid in pulling the pellets around the subject.

The connector 42 that couples the launcher to the projectile casing can take a variety of forms, including the threaded version shown in FIGS. 1-3A. In addition to a threaded connector, a twist-lock connector can be used, as well as a bayonet-style connector, and other suitable connectors. The connector should allow, or at least not interfere with, fluid communication between the projectile casing and the firearm or launcher. The connector can be associated with the projectile casing in such a manner that a specific alignment between the casing and the firearm or launcher can be achieved. This alignment structure can take a variety of forms. In the example shown, the threaded connector can be oriented relative to the projectile casing such that the casing, when tightened against the muzzle end of the firearm, is seated in a specific orientation.

The connector 42 can provide releasable engagement between the projectile casing 40 and the firearm or launcher (18, 18', etc.). In this manner, once an entangling projectile is deployed from the casing, that casing can be quickly and easily removed from the launcher and quickly replaced with a fresh casing (or a freshly loaded casing). Thus, in a matter of seconds, law enforcement can deploy one projectile (or multiple projectiles at one time), replace the casing, and deploy a further projectile. In the embodiments where the launcher can carry multiple charges, the deployment system can be recharged as quickly as the projectile casing can be interchanged. Known "quick-connect" connectors, such as bayonet connectors, can be utilized to speed this process.

FIGS. 4A and 8 illustrate one application wherein proper alignment of the inner block 50 of the projectile casing 40 can be advantageous. As will be appreciated from FIG. 4A, each of sockets 30*a*, 30*b* (along with their respective pellets) can be oriented on opposing sides of a vertical centerline 72. By aligning the sockets in this manner, the pellets are expelled outwardly from the casing at different vertical trajectories. This can ensure that the pellets 14, as the projectile 12 approaches the subject, are not at the same elevation, as is demonstrated in FIG. 8. In this manner, when the tether 16 contacts the subject 100, causing the pellets to begin rotating about the subject, the pellets do not collide with one another during rotation about the subject's legs. A collision of the pellets can cause them to be diverted from their intended path, possibly interfering with properly wrapping about the subject's legs or torso. Proper alignment of the casing 40 can avoid this outcome.

It is noted that the sockets 30*a*, 30*b* are illustrated in FIG. 4A with their exit points oriented on opposing sides of the vertical centerline 72. However, in some embodiments, the exit points need not be oriented in any particular location, as the socket axes can be angled and/or overlapped relative to one another to ensure that the pellets follow different vertical trajectories. The example shown in FIG. 4A is but one manner of accomplishing this.

To aid in proper alignment of the sockets, alignment indicia 70 can be disposed on the outer shell 48, as shown by example in FIGS. 1-3B. The indicia can be utilized to ensure that an operator, where possible, aligns the projectile casing 40 in a specific orientation relative to the firearm or launcher. For example, operators can be instructed to ensure that indicia 70 is aligned with a top portion of the firearm or launcher. As an operator will generally hold the launcher or firearm in a specific orientation when firing, proper orientation of the alignment indicia relative to the firearm or launcher will ensure the projectile shell is aligned properly relative to the subject when fired.

Figure 9A:
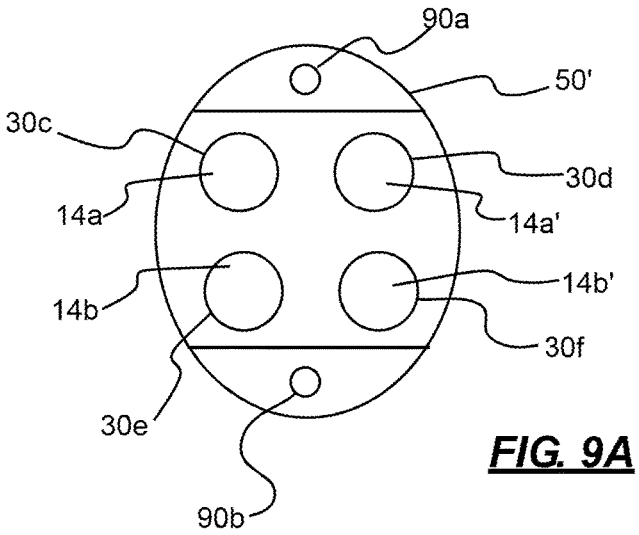
FIG. 9A is a front view of an inner casing of a projectile casing in accordance with another embodiment of the invention.
Figure 9B:
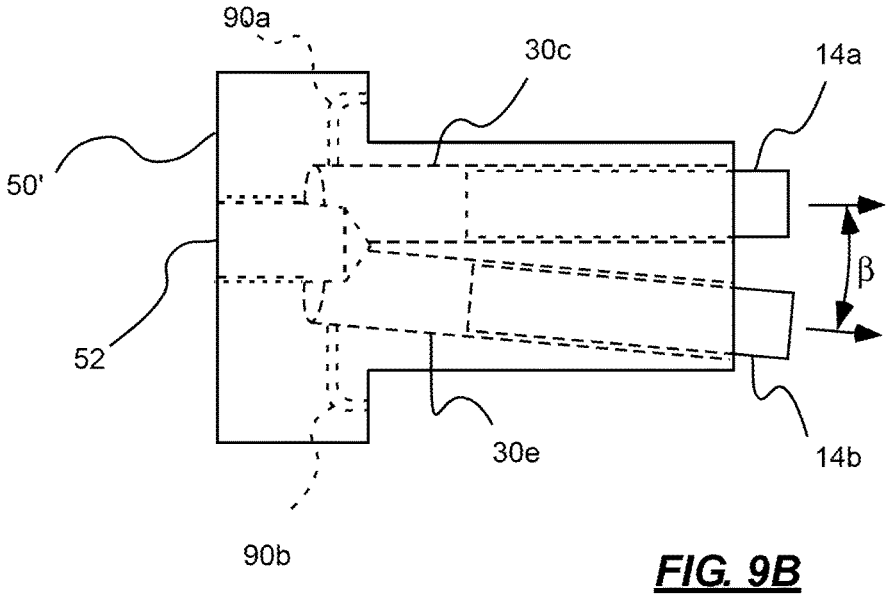
FIG. 9B is a side view of the inner casing of FIG. 9A.

FIGS. 9A and 9B illustrate an alternate embodiment of the invention in which four sockets, 30*c*, 30*d*, 30*e* and 30*f* are formed in inner block 50'. As shown in FIG. 9B, the upper sockets 30*c*, 30*d* carrying pellets 14*a*, 14*a'* are directed forwardly of the block, while lower sockets 30*e*, 30*f* carrying pellets 14*b*, 14*b'* are angled relative to the upper sockets by angle "β." Each pair of sockets can also be oriented as illustrated in FIG. 4A. In this embodiment, aiming the launcher that contains block 50' toward a target can result in directing one projectile including pellets 14*a*, 14*a'* toward a subject's torso, while a second projectile including pellets 14*b*, 14*b'* is directed toward the subject's legs. This can provide more opportunities to temporarily incapacitate the subject. This arrangement can also allow law enforcement personnel to direct the launcher toward a subject's body mass. As many law enforcement personnel are trained to direct fire at a subject's torso rather than the subject's legs, this may ensure that the projectile launcher is properly utilized by law enforcement. The angle "β" can vary, but the present inventors have found that as little as 6 degrees is sufficient to cause two projectiles to contact a subject's body in different areas.

In the embodiment shown in FIGS. 9A and 9B, channel 52 provides fluid communication to all four sockets 30*c*, 30*d*, 30*e* and 30*f*. Thus, activation of the energy source 22 (not shown in these figures) results in both projectiles being expelled from the block 50'. It is to be understood, however, that the system can be configured to provide a pressure wave to the upper sockets independently of the lower sockets, to allow, for example, law enforcement personnel to select which projectile to deploy. Likewise a block could contain more than two pairs of sockets that can fire simultaneously, or they can be configured to fire separately by one or more triggering mechanisms.

Returning to FIGS. 1 and 2, these are but two examples of the types of launchers suitable for use with the present technology. The launcher of FIG. 1 is a revolver-type firearm 18, while the launcher of FIG. 2 is a semi-automatic pistol. The firearm 18, 18' can carry an energy source 22, which can be energized when a user activates trigger 20, 20'. The energy source can take a variety of forms, including a cartridge blank. Cartridge blanks are well known to those of ordinary skill in the art; they are fired in the same manner in which ordinary casings or shells are fired by a firearm. However, firing of such blanks produces primarily a high velocity pressure wave without an accompanying bullet or shot. Thus, in these examples, the energy source 22, 22' is energy stored in the form of gunpowder within a brass casing. By activating trigger 20, 20', respectively, the energy source is activated and generates a pressure wave that is directed into projectile casing 40.

In these examples, projectile casing 40 is coupled to the firearm 18, 18' by way of connector 42. Activation of the energy source 22, 22' (e.g., a cartridge blank) causes a high velocity pressure wave to be expelled from the muzzle end 19, 19', respectively, of the firearm. This high velocity pressure wave then enters a pressure input end (44 in FIG. 3A) of the projectile casing 40, where the pressure wave is utilized to expel the entangling projectile through the output end (44 in FIG. 3A), as discussed above.

The launcher 18 shown in FIG. 1 is either an actual revolver, or a firearm designed to mimic operation of a revolver. In this type of firearm, one or more energy sources, i.e., cartridge blanks, 22 are carried by the firearm, typically in a cylinder that revolves as the trigger is pulled. In this manner, a fresh cartridge is rotated into firing position each time the trigger is pulled. The launcher 18' shown in FIG. 2 is a semi-automatic pistol. In this type of firearm, a series of cartridge blanks is carried in a clip: as each blank is fired, the empty casing is ejected and a fresh blank is positioned in firing position.

The present inventors have designed the present technology to allow the use of commercially available cartridge blanks and blank guns or prop guns. When appropriately configured, these guns and "ammunition" can be used to generate a high velocity pressure wave to expel the entangling projectile from the firearm 18, 18' with sufficient force to engage a subject. Commercially available blank cartridges of full, half and quarter power can be used, to enable the system to be tailored for particular projectiles, projectile casings, etc. Alternatively, custom loadings tailored to a specific power requirement may be employed.

In addition to utilizing firearms that use blank cartridges as energy sources, a variety of other energy sources can be utilized. These include, without limitation, $CO_2$ cartridges, compressed air systems, spring-loaded assemblies, and the like. All various energy sources capable of generating a suitable pressure wave, and directing that pressure wave into the projectile casing, are suitable for use with the present technology.

In addition to the firearms illustrated in the figures, custom firearm configurations can be utilized to achieve the desired power output and connections to projectile casings. In other embodiments, the launcher can be customized to be appended to other tools used by law enforcement, including rifles, shotguns, flashlights, batons and the like.

Figure 10A:
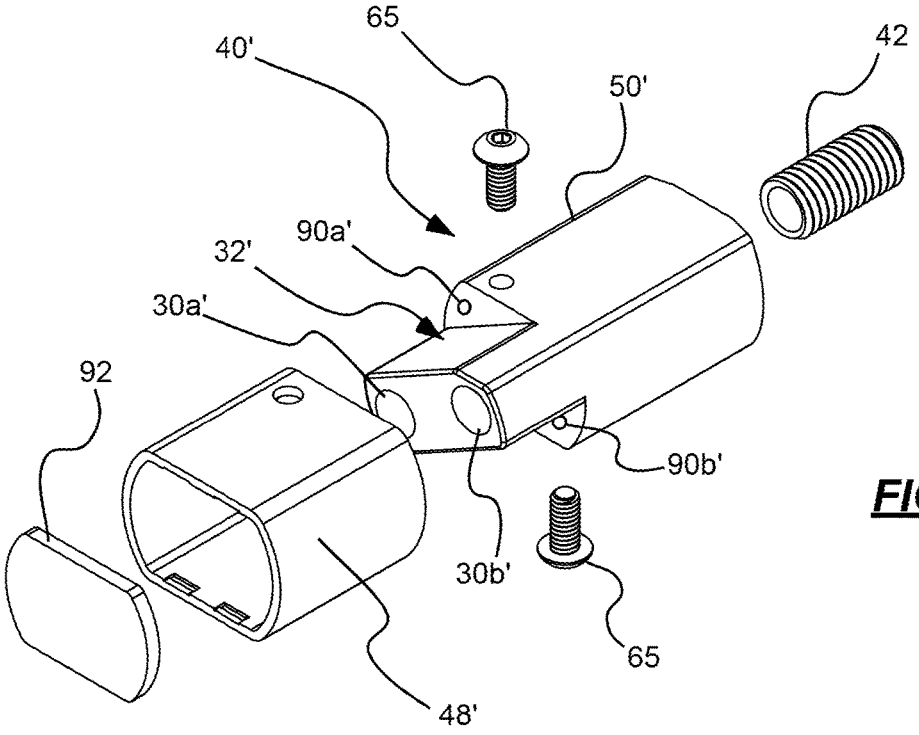
FIG. 10A is an exploded, perspective view of a projectile casing in accordance with an embodiment of the invention.
Figure 10B:
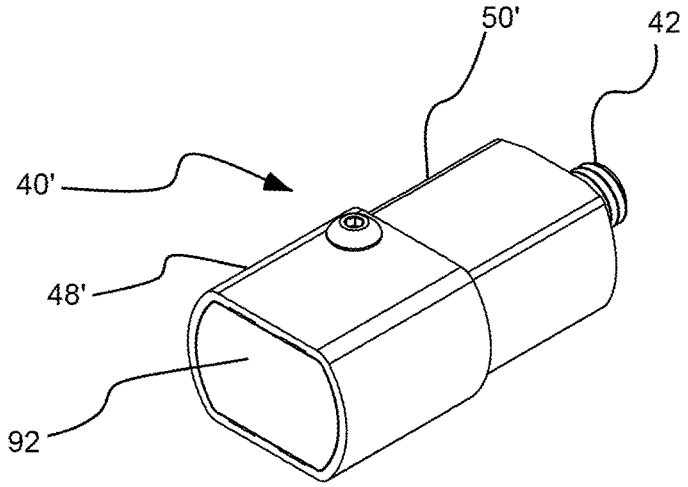
FIG. 10B is a perspective view of the projectile casing of FIG. 10A, shown assembled.

FIGS. 10A and 10B illustrate another embodiment of the invention in which projectile casing 40' is formed from multiple components. In this embodiment, inner block 50' and outer case or shell 48' are removably coupled to one another via connectors 65. The inner block can include a recessed section 32' that, when contained within outer case 48', creates a tether compartment analogous to that shown at 32 in FIG. 3A. A cover or cap 92 (FIG. 10A) can be releasably engaged within the outer case to provide protection to the entangling projectile (not shown in this view) and to cover sockets 30*a'*, 30*b'*. The cover or cap can be snap fit within the cover so as to be relatively easily removed as the entangling projectile is deployed from the casing. This embodiment is advantageous in that the various components can be relatively easily dissembled for cleaning, repair and reloading of an entangling projectile.

Also shown in FIG. 10A, as well as FIGS. 9A and 9B, is through-channel 90*a*, 90*b*, 90*a'*, 90 *b'*, etc., that provides fluid communication between the launcher and the tether compartment 32, 32'. In this embodiment, deployment of the launcher, which results in deployment of the entangling projectile, also results in providing a high-velocity pressure wave through the tether compartment. This can aid in expelling the coiled tether from the casing, along with the pellets, to achieve a more successful launch of the entire entangling projectile. As shown, it may be the case that the through-channel 90 need not be sized a large as the sockets 30, as the coiled tether need not be propelled at the same velocity as the pellets, it merely needs to be expelled from the casing, after which it will begin to uncoil in response to the force applied by the pellets.

In addition to the structural components discussed above, the present invention also provides a method of entangling a subject, including: targeting a subject with a projectile launcher, the projectile launcher carrying an entangling projectile having a pair of pellets connected by a tether, each of the pellets carried by one of a pair of sockets formed in the launcher; and activating the projectile launcher to cause the pellets to be expelled from the projectile launcher, the pellets traveling outwardly from the projectile launcher and laterally away from one another as they are being expelled from the projectile launcher.

The method can include spacing the projectile launcher a distance from the subject such that the tether is at substantially maximum extension at the point the entangling projectile engages the subject. The tether can be elastic such that the tether can expand as the pellets are expelled from the projectile casing. The projectile launcher can include a compressed gas cylinder carried by the projectile launcher, or a cartridge blank carried by the projectile launcher.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

We claim:

1. A method for entangling a subject, comprising:

holding a projectile launcher in a firing orientation, the projectile launcher having a pair of sockets formed therein, each of the sockets being substantially parallel with the horizontal plane when the projectile launcher is held in the firing orientation, the projectile launcher carrying an entangling projectile, the entangling projectile including:

a first pellet and a second pellet connected by a single tether, the single tether being coupled only to the first pellet and the second pellet, each of the first and second pellets being carried by one of the pair of sockets formed in the launcher, the sockets carrying at least a portion of each of the pair of pellets at differing vertical elevations;

targeting a subject with the projectile launcher; and activating the projectile launcher to cause the pellets to be expelled from the projectile launcher, the first and second pellets traveling outwardly from the projectile launcher at differing vertical elevations and laterally away from one another as they are being expelled from the projectile launcher; wherein activating the projectile launcher causes the pellets to pull the single tether into a taught, linear configuration while traveling, with the pellets having differing vertical elevations relative to one another when the single tether contacts the subject while in the taught, linear configuration.

2. The method of claim 1, further comprising spacing the projectile launcher a distance from the subject such that the tether is at substantially maximum extension at the point the entangling projectile engages the subject.

3. The method of claim 1, wherein activating the projectile launcher includes activating a compressed gas cylinder carried by the projectile launcher.

4. The method of claim 1, wherein activating the projectile launcher includes activating a cartridge blank carried by the projectile launcher.

5. The method of claim 1, wherein expelling the pellets includes expelling the pellets at an angle of between about 10 degrees and about 60 degrees relative to one another.

6. The method of claim 1, wherein expelling the pellets includes expelling the pellets at an angle of between about 25 degrees and about 45 degrees relative to one another.

7. The method of claim 1, wherein the tether extends from one of the pair of sockets to another of the pair of sockets prior to activating the projectile launcher.

8. The method of claim 1, wherein the tether and the pellets are aligned on a common plane when the tether is in the taught, linear configuration.

9. The method of claim 1, wherein the pellets apply equal and opposing forces on the tether when the tether is in the taught, linear configuration.

10. The method of claim 1, wherein the tether is extended to a full length between the pellets when the tether is in the taught, linear configuration.

11. A method for entangling a subject, comprising:

holding a projectile launcher in a firing orientation, the projectile launcher carrying a pair of sockets, each of the sockets being substantially parallel with the horizontal plane when the projectile launcher is held in the firing orientation, with at least portions of each of the pair of sockets being positioned at differing vertical elevations when the projectile launcher is held in the firing orientation, the projectile launcher carrying an entangling projectile, the entangling projectile including:

a first pellet and a second pellet connected by a single tether, the single tether being coupled only to the first pellet and the second pellet, each of the first and second pellets being carried by one of the pair of sockets formed in the launcher;

targeting a subject with the projectile launcher; and activating the projectile launcher to cause the pellets to be expelled from the projectile launcher, the first and second pellets traveling outwardly from the projectile launcher at differing vertical elevations and laterally away from the projectile launcher as they are being expelled from the projectile launcher.

12. The method of claim 11, wherein the tether extends from one of the pair of sockets to another of the pair of sockets prior to activating the projectile launcher.

13. The method of claim 11, wherein the tether and the pellets are aligned on a common plane when the tether is in a taught, linear configuration.

14. The method of claim 11, wherein the pellets apply equal and opposing forces on the tether when the tether is in a taught, linear configuration.

15. The method of claim 11, wherein the tether is extended to a full length between the pellets when the tether is in the taught, linear configuration.

16. A method for entangling a subject, comprising:

holding a projectile launcher in a firing orientation, the projectile launcher having a pair of sockets associated therewith, each of the sockets being substantially parallel with one another when the projectile launcher is held in the firing orientation and at least portions of each of the sockets being at different vertical elevations when held parallel to one another, the projectile launcher carrying an entangling projectile, the entangling projectile including:

a first pellet and a second pellet connected by a single tether, the single tether being coupled only to the first pellet and the second pellet, each of the first and second pellets being carried by one of the pair of sockets associated with the launcher;

targeting a subject with the projectile launcher; and activating the projectile launcher to cause the pellets to be expelled from the projectile launcher, the first and second pellets traveling outwardly from the projectile launcher at differing vertical elevations and laterally away from the projectile launcher as they are being expelled from the projectile launcher.

17. The method of claim 16, wherein the tether extends from one of the pair of sockets to another of the pair of sockets prior to activating the projectile launcher.

18. The method of claim 16, wherein the tether and the pellets are aligned on a common plane when the tether is in the taught, linear configuration.

19. The method of claim 16, wherein the pellets apply equal and opposing forces on the tether when the tether is in the taught, linear configuration.

20. The method of claim 16, wherein the tether is extended to a full length between the pellets when the tether is in the taught, linear configuration.

* * * * *